US010482861B2

(12) United States Patent
Harimoto et al.

(10) Patent No.: US 10,482,861 B2
(45) Date of Patent: Nov. 19, 2019

(54) REACTION FORCE GENERATOR AND KEYBOARD DEVICE OF ELECTRONIC MUSICAL INSTRUMENT

(71) Applicant: YAMAHA CORPORATION, Hamamatsu-shi (JP)

(72) Inventors: Hiroshi Harimoto, Hamamatsu (JP); Ichiro Osuga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 52 days.

(21) Appl. No.: 15/894,142

(22) Filed: Feb. 12, 2018

(65) Prior Publication Data

US 2018/0204554 A1 Jul. 19, 2018

Related U.S. Application Data

(63) Continuation of application No. PCT/JP2016/073809, filed on Aug. 5, 2016.

(30) Foreign Application Priority Data

Aug. 24, 2015 (JP) ..... 2015-164766

(51) Int. Cl.
*G10H 1/34* (2006.01)
*H01H 13/85* (2006.01)
(Continued)

(52) U.S. Cl.
CPC ..... *G10H 1/346* (2013.01); *G10H 1/34* (2013.01); *H01H 13/85* (2013.01); *G10B 3/12* (2013.01);
(Continued)

(58) Field of Classification Search
CPC . G10H 1/346; G10H 1/34; G10B 3/12; G10C 3/12; H01H 13/85; H01H 2215/004; H01H 2215/02; H01H 2231/018
(Continued)

(56) References Cited

U.S. PATENT DOCUMENTS 4,079,651 A * 3/1978 Matsui ..... G10H 1/0558 338/69
4,257,305 A * 3/1981 Friend ..... G10H 1/0558 338/114
(Continued)

FOREIGN PATENT DOCUMENTS

CN 203300522 U 11/2013
CN 103681056 A 3/2014
(Continued)

OTHER PUBLICATIONS

Office Action issued in Chinese Application No. 201680049245.0 dated Sep. 30, 2018. English translation provided.
(Continued)

*Primary Examiner* — David S Warren
*Assistant Examiner* — Christina M Schreiber
(74) *Attorney, Agent, or Firm* — Rossi, Kimms & McDowell LLP

(57) ABSTRACT

In a key switch (10), an inner dome (Din) starts to deform once a distal end portion (21) of the inner dome (Din) comes into contact with a base surface (93*a*) after an outer dome (Dout) starts to deform. A thick portion (25) extending straight and having a uniform wall thickness in a click generating portion (CL) has the thickness less than or equal to the minimum thickness of a thick portion (23) of an after stroke portion (AF). The degree of inclination of the thick portion (25) with respect to a center line (C0) (direction of pressing) is larger than that of the thick portion (23) with
(Continued)

respect to the center line (C0) (θc>θa). Before the after stroke portion (AF) undergoes large deformation, the click generating portion (CL) undergoes buckling to cause a sudden decrease in a reaction force and generate a click feeling.

12 Claims, 7 Drawing Sheets

(51) Int. Cl.
*G10B 3/12* (2006.01)
*G10C 3/12* (2006.01)

(52) U.S. Cl.
CPC ..... *G10C 3/12* (2013.01); *H01H 2215/004* (2013.01); *H01H 2215/02* (2013.01); *H01H 2231/018* (2013.01)

(58) Field of Classification Search
USPC ..... 84/744
See application file for complete search history.

(56) References Cited

U.S. PATENT DOCUMENTS 5,717,176 A * 2/1998 Dahlstrom ..... H01H 13/64 200/1 B
6,275,138 B1 * 8/2001 Maeda ..... H01C 10/106 338/128
7,256,359 B2 * 8/2007 Nishida ..... G10H 1/346 200/1 B
8,624,140 B2 * 1/2014 Nishino ..... H01H 3/122 200/302.2
9,489,006 B2 * 11/2016 Harimoto ..... G05G 5/03
10,304,433 B2 * 5/2019 Kuno ..... G10H 1/346
10,311,846 B2 * 6/2019 Tanoue ..... G10H 1/344
2002/0079211 A1 * 6/2002 Katayama ..... H01H 3/125 200/517
2003/0209418 A1 * 11/2003 Yanai ..... H01H 13/44 200/406
2005/0160903 A1 * 7/2005 Nagaoka ..... G10H 1/344 84/745
2007/0295192 A1 * 12/2007 Watanabe ..... G10H 1/344 84/423 R
2008/0149470 A1 * 6/2008 Tomitsuka ..... H01H 13/7006 200/5 A
2009/0272639 A1 * 11/2009 Mittleman ..... H01H 13/79 200/345
2010/0108486 A1 * 5/2010 Yoshida ..... H01H 13/85 200/520
2014/0069793 A1 * 3/2014 Ely ..... H01H 13/85 200/5 A
2014/0097073 A1 * 4/2014 Kikuchi ..... H01H 13/14 200/512
2014/0116867 A1 * 5/2014 Leong ..... H01H 13/14 200/513
2015/0001058 A1 * 1/2015 Chen ..... H01H 13/85 200/5 A
2015/0064515 A1 * 3/2015 Brazier ..... H01M 2/1229 429/61
2015/0090098 A1 * 4/2015 Osuga ..... G10C 3/12 84/433
2015/0090103 A1 * 4/2015 Osuga ..... G10H 1/346 84/744
2015/0090104 A1 * 4/2015 Osuga ..... G10H 1/32 84/744
2015/0220105 A1 * 8/2015 Harimoto ..... G05G 5/03 200/239
2017/0351339 A1 * 12/2017 Kawaguchi ..... G06F 3/02
2018/0005777 A1 * 1/2018 Yashima ..... H01H 13/14
2018/0204554 A1 * 7/2018 Harimoto ..... G10H 1/34
2018/0286605 A1 * 10/2018 Tanoue ..... G10H 1/346
2019/0043462 A1 * 2/2019 Kuno ..... G10H 1/346

FOREIGN PATENT DOCUMENTS

CN 104835484 A 8/2015
JP S4733960 U 12/1972
JP S58117615 A 7/1983
JP S645327 U 1/1989
JP H04106824 A 4/1992
JP H0612941 A 1/1994
JP H06251652 A 9/1994

OTHER PUBLICATIONS

International Search Report issued in Intl. Appln. No. PCT/JP2016/073809 dated Nov. 8, 2016. English translation provided.
Written Opinion issued in Intl. Appln. No. PCT/JP2016/073809 dated Nov. 8, 2016.
Office Action issued in Japanese Appln. No. 2015-164766 dated Jun. 18, 2019. English translation provided.

* cited by examiner

REACTION FORCE GENERATOR AND KEYBOARD DEVICE OF ELECTRONIC MUSICAL INSTRUMENT

CROSS REFERENCE TO RELATED APPLICATIONS

The present application is a continuation application of International Patent Application No. PCT/JP2016/073809 filed on 5 Aug. 2016, which claims priority to Japanese Patent Application No. 2015-164766, filed on 24 Aug. 2015. The contents of these applications are incorporated herein by reference in their entirety.

BACKGROUND OF THE INVENTION

Technical Field

The present invention relates to a reaction force generator that generates a reaction force against an operation through elastic deformation of an elastic dome, and to a keyboard device of an electronic musical instrument.

Background Art

A conventionally known reaction force generator generates a reaction force against an operation through elastic deformation of an elastic dome. For example, the invention according to Patent Literature 1 (JP 06-251652) uses a rubber dome as a key operation detection switch in a keyboard device of an electronic musical instrument. This invention is provided with a plurality of reaction force generating portions that generate reaction force peaks at different positions in a key depression stroke by varying the thickness of a wall portion forming the skirt of an outer dome or an inner dome depending on a spot. A desired reaction force characteristic is realized by combining characteristics of the plurality of reaction force generating portions.

Technical Problem

An acoustic piano with an action mechanism generates a click feeling immediately before a hammering timing. Accordingly, the keyboard device of an electronic musical instrument can also provide a preferable operational feel when a click feeling is generated at a position immediately before a sounding timing (key-on) in the key depression stroke. The click feeling is generated due to a difference in the reaction force, so that the reaction force peak needs to occur during the key depression stroke.

However, in the keyboard device using the rubber dome switch as a key depression detecting mechanism, the deformation of the wall portion of the skirt normally starts from a curved area of the wall portion and gradually expands therefrom. It is thus difficult to generate a distinct reaction force peak during the key depression stroke and to generate the click feeling. Even if the reaction force peak occurs during the key depression stroke, the click feeling is accompanied by a sense of strangeness unless the position of the peak is properly matched with the sounding timing, whereby the reaction force peak needs to occur at an accurate position.

Note that a change in the reaction force like the click feeling is useful not only for the keyboard device but for various devices, and thus the characteristic and the position of occurrence of the change in the reaction force are required to be determined appropriately depending on an operator of each device.

SUMMARY

Solution to Problem

It is an object of the present invention to provide a reaction force generator and a keyboard device of an electronic musical instrument each of which generates a click feeling at an appropriate position in a pressing stroke.

According to the present invention, there is provided a reaction force generator that is disposed on a base surface, includes an elastic structure and a dome that is made of an elastic member, includes a portion bulging toward the base surface and includes at least an after stroke portion and a click generating portion, and generates a reaction force by elastic deformation of the elastic structure and the dome in a pressing process in which the elastic structure is pressed, where the after stroke portion and the click generating portion are both inclined with respect to the direction of pressing in the dome, the click generating portion has one end connected to the after stroke portion, a degree of inclination of a thick portion between both ends of the click generating portion with respect to the direction of pressing is larger than a degree of inclination of the after stroke portion with respect to the direction of pressing, the dome starts to deform once a distal end portion of the dome comes into contact with the base surface after the elastic structure starts to deform in the pressing process, the click generating portion undergoes buckling in the pressing process to cause a sudden decrease in a reaction force and generate a click feeling, the click generating portion causes a sudden increase in an amount of deformation before the after stroke portion, and the amount of deformation of the after stroke portion increases rapidly after the click generating portion undergoes buckling.

According to the present invention, there is provided a keyboard device of an electronic musical instrument including a reaction force generator that is disposed on a base surface, includes an elastic structure and a dome that is made of an elastic member, includes a portion bulging toward the base surface and includes at least an after stroke portion and a click generating portion, and generates a reaction force by elastic deformation of the elastic structure and the dome in a pressing process in which the elastic structure is pressed by a performance operation, where the after stroke portion and the click generating portion are both inclined with respect to the direction of pressing in the dome, the click generating portion has one end connected to the after stroke portion, a degree of inclination of a thick portion between both ends of the click generating portion with respect to the direction of pressing is larger than a degree of inclination of the after stroke portion with respect to the direction of pressing, the dome starts to deform once a distal end portion of the dome comes into contact with the base surface after the elastic structure starts to deform in the pressing process, the click generating portion undergoes buckling in the pressing process to cause a sudden decrease in a reaction force and generate a click feeling, and a maximum peak of the reaction force generated by the dome in the pressing process is positioned in a first half of a dome stroke spanning from the contact between the distal end portion of the dome and the base surface to an end of the performance operation.

According to the present invention, there is provided a keyboard device of an electronic musical instrument including a reaction force generator that is disposed on a base surface, includes an elastic structure and a plurality of domes that is made of an elastic member and each includes a portion bulging toward the base surface, and generates a reaction force by elastic deformation of the elastic structure and the domes in a pressing process in which the elastic structure is pressed by a performance operation, and one of the plural domes includes at least an after stroke portion and a click generating portion, where the after stroke portion and the click generating portion are both inclined with respect to the direction of pressing in the dome including the click generating portion, the click generating portion has one end connected to the after stroke portion, a degree of inclination of a thick portion between both ends of the click generating portion with respect to the direction of pressing is larger than a degree of inclination of the after stroke portion with respect to the direction of pressing, plural electrical contacts detecting the performance operation by conduction are respectively formed at the distal end portion of each of the domes and on the base surface facing the distal end portions, a distance between the distal end portion of each of the plurality of domes and the base surface is different for each dome at the time of no performance operation, the domes start to deform in order of contact between the distal end portion and the base surface after the elastic structure starts to deform in the pressing process, the dome including the click generating portion is a dome with the distal end portion coming into contact with the base surface second from the last in the pressing process, and the click generating portion undergoes buckling in the pressing process to cause a sudden decrease in a reaction force and generate a click feeling.

According to the present invention, there is provided a keyboard device of an electronic musical instrument including a reaction force generator that is disposed on a base surface, includes an elastic structure and two domes that are made of an elastic member and each include a portion bulging toward the base surface, and generates a reaction force by elastic deformation of the elastic structure and the domes in a pressing process in which the elastic structure is pressed by a performance operation, and one of the two domes includes at least an after stroke portion and a click generating portion, where the after stroke portion and the click generating portion are both inclined with respect to the direction of pressing in the dome including the click generating portion, the click generating portion has one end connected to the after stroke portion, a degree of inclination of a thick portion between both ends of the click generating portion with respect to the direction of pressing is larger than a degree of inclination of the after stroke portion with respect to the direction of pressing, plural electrical contacts detecting the performance operation by conduction are respectively formed at the distal end portion of each of the domes and on the base surface facing the distal end portions, distances between the distal end portions of the two domes and the base surface are different from each other at the time of no performance operation, the domes start to deform in order of contact between the distal end portion and the base surface after the elastic structure starts to deform in the pressing process, the dome including the click generating portion is a dome with the distal end portion coming into contact with the base surface second in the pressing process, and the click generating portion undergoes buckling in the pressing process to cause a sudden decrease in a reaction force and generate a click feeling.

DETAILED DESCRIPTION

Embodiments of the present invention will now be described with reference to the drawings.

Figure 1:
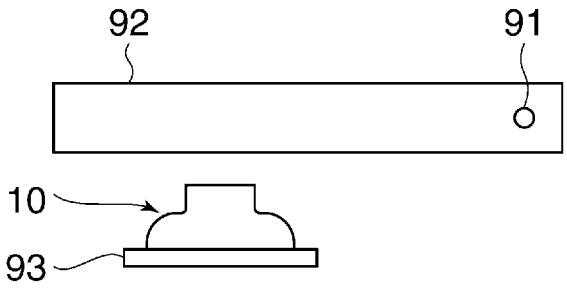
FIG. 1 is a schematic diagram schematically illustrating a part of the configuration of a keyboard device of an electronic musical instrument to which a reaction force generator according to a first embodiment of the present invention is applied.

FIG. 1 is a schematic diagram schematically illustrating a part of the configuration of a keyboard device of an electronic musical instrument to which a reaction force generator according to a first embodiment of the present invention is applied. The keyboard device includes keys 92 as a plurality of performance operators. FIG. 1 however illustrates only one key 92 as a representative of the plurality of keys. A substrate 93 is disposed below the key 92, and a key switch 10 as the reaction force generator is disposed on the substrate 93. When depressed, the key 92 turns about a pivot 91 to drive the key switch 10. The key switch 10 being driven causes a musical tone generator (not shown) to generate a musical tone signal and a reaction force to be applied to the key 92, as will be described in detail later. This reaction force gives a performer the feel like when he/she plays an acoustic piano.

Figure 2:
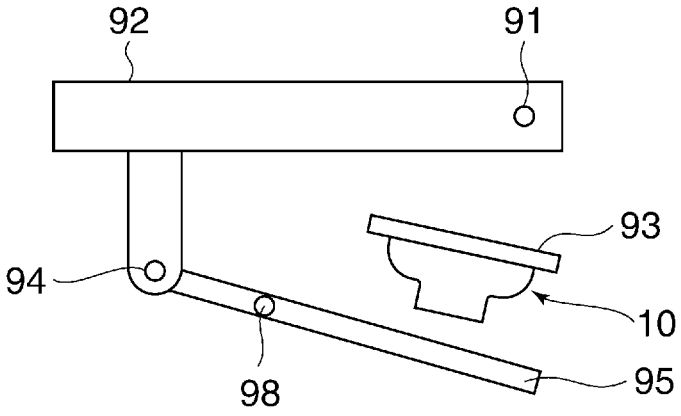
FIG. 2 is a schematic diagram schematically illustrating a part of the configuration of a variation of the keyboard device of an electronic musical instrument to which the reaction force generator according to the first embodiment of the present invention is applied.

Note that a driver driving the key switch 10 is not limited to the key 92 but may be a hammer. As illustrated in FIG. 2, for example, a hammer 95 is always engaged with the key 92 by a drive transmission portion 94 so that driving force from the key 92 can be transmitted to the hammer 95. The hammer 95 is disposed turnably about a pivot 98. The substrate 93 is disposed above the hammer 95, and the key switch 10 is disposed on a lower surface of the substrate 93. When the key 92 is depressed, the hammer 95 is driven through the drive transmission portion 94 and turns about the pivot 98 to drive the key switch 10. Note that the position at which the substrate 93 and the key switch 10 are disposed is not limited to the upper side of the hammer 95 but may be below the hammer 95 between the drive transmission portion 94 and the pivot 98.

The configuration of the key switch 10 is basically the same as a conventional configuration in which a movable contact and a fixed contact form one contact switch. FIGS. 3 and 5A to 5F illustrate an example in which the key switch 10 is of a one-make type that has one switch corresponding to the key 92.

Figure 3:
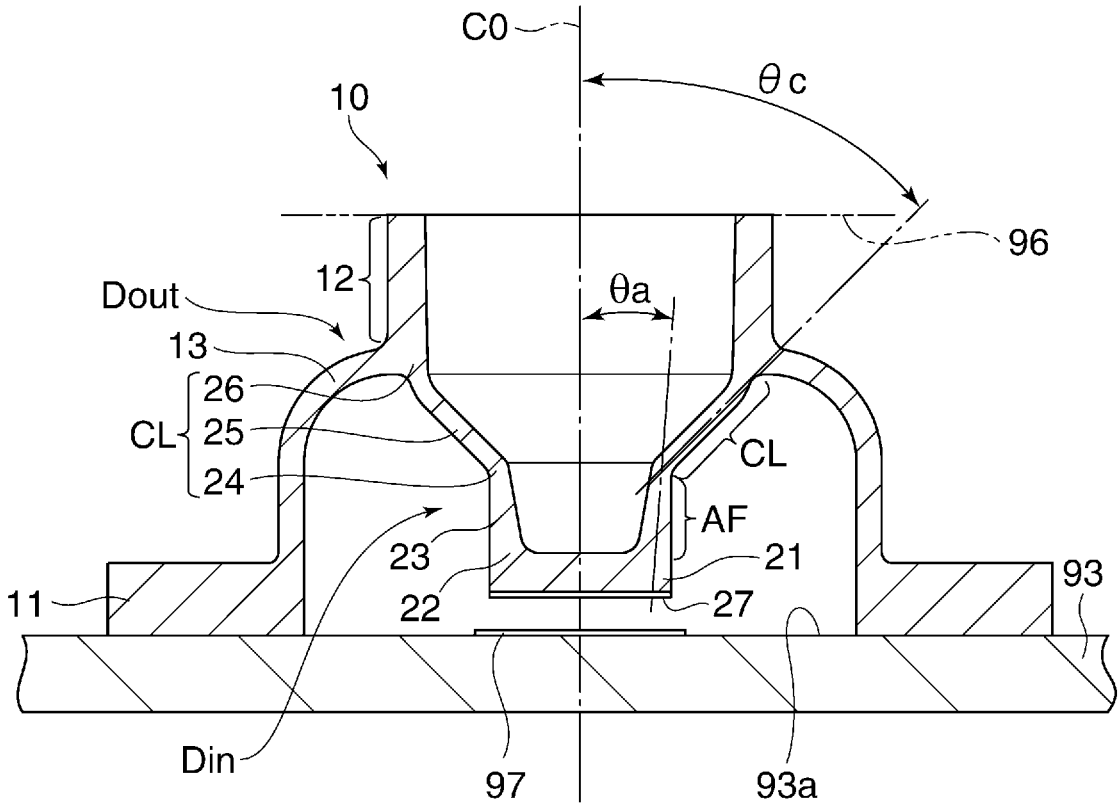
FIG. 3 is a longitudinal sectional view of a key switch serving as the reaction force generator according to the first embodiment of the present invention.

FIG. 3 is a longitudinal sectional view of the key switch 10 in FIGS. 1 and 2. The key switch 10 includes a base portion 11, an outer dome Dout, and an inner dome Din, and is integrally formed of an elastic member such as rubber except for a carbon portion. The outer dome Dout includes a head portion 12 that is pressed to be driven by a driver 96. The driver 96 corresponds to the key 92 or the hammer 95. A center line C0 in FIG. 3 is substantially parallel to the direction of pressing exerted by the driver 96. Strictly speaking, the direction of pressing can change gradually in a pressing and driving process, but the direction of pressing at the moment when the driver 96 comes into contact with the head portion 12 or when the inner dome Din (to be described later) generates a reaction force peak may be defined as a representative direction of pressing. Alternatively, assuming a flat upper surface as a contact surface of the head portion 12 to be in contact with the driver 96, a direction orthogonal to the upper surface of the head portion 12 may be defined as the direction of pressing. When viewed from an axial direction of the center line C0, the outer dome Dout and the inner dome Din are concentric circles, through the centers of which the center line C0 passes. The outer shape of the base portion 11 may be any shape such as a rectangle in a plan view.

The head portion 12 of the outer dome Dout is pressed in the pressing process (corresponding to a forward key depressing process) by the driver 96, whereby a reaction force against the pressing is generated by elastic deformation of the outer dome Dout and the inner dome Din. This reaction force acts as a reaction force against a key depressing operation such as to act on a performer as a key depression feeling.

The base portion 11 is fixed to the substrate 93, and the outer dome Dout bulges out from the base portion 11 in a direction away from a base surface 93*a* of the substrate 93. The inner dome Din is formed on the inner side of the outer dome Dout and bulges out to a side (toward the base surface 93*a*) opposite to the bulging of the outer dome Dout. The base portion 11 and the head portion 12 are connected by a skirt portion 13 having a curved portion. Note that the skirt portion 13 forms a part of the outer dome Dout. An end of the head portion 12 is flat.

The inner dome Din includes, as elements constructing a part thereof, a click generating portion CL that mainly plays a role of generating a click feeling, an after stroke portion AF that mainly plays a role of characterizing a change in the reaction force after a click is generated, and a distal end portion 21. The click generating portion CL is connected to the after stroke portion AF at a connecting portion 24. The connecting portion 24 is one end of the click generating portion CL and also one end of the after stroke portion AF. The click generating portion CL is also connected to the outer dome Dout at a connecting portion 26. The connecting portion 26 is also another end of the click generating portion CL. The connecting portion 26 is also a part of a connection area between the head portion 12 and the skirt portion 13 of the outer dome Dout. The after stroke portion AF is connected to the distal end portion 21 at a connecting portion 22.

A distal end surface of the distal end portion 21 is a flat surface facing the base surface 93*a* in parallel therewith, where a movable contact 27 made of a conductive material such as carbon is formed on the flat surface. A fixed contact 97 made of a conductive material such as carbon is formed in an area on the base surface 93*a* facing the movable contact 27. The movable contact 27 and the fixed contact 97 make up a pair of electrical contacts. A pressing operation is detected by conduction between the contacts, whereby a detection signal is transmitted (key-on detection in a performance operation in this case). Note that the present electronic musical instrument includes a CPU and the musical tone generator (not shown), where the detection signal of the key switch 10 is given to the CPU to cause the musical tone generator to generate a musical tone at a timing corresponding to the detection.

An end position of pressing by the driver 96 is fixed in the pressing process. The end position of pressing is for example regulated by a stopper (not shown) that regulates the end of turning of the key 92 or the hammer 95. In the pressing process, a stroke from the time when the distal end portion 21 comes into contact with the base surface 93*a* to the end of pressing (end of the performance operation) is hereinafter referred to as an "inner dome stroke". The inner dome stroke corresponds to a region in the latter half of the key depression stroke of the key 92. As a result, a click feeling like that of an acoustic piano can be given in the latter half of the key depression stroke.

The shape of the inner dome Din is devised in the present embodiment such that the click generating portion CL causes a sudden increase in the amount of deformation before a sudden increase in the amount of deformation of the after stroke portion AF in the pressing process. Specifically, the rigidity in the direction of pressing of the click generating portion CL is made smaller than the rigidity in the direction of pressing of the after stroke portion AF. The shape of the inner dome Din is further devised such that, in the pressing process, the click generating portion CL undergoes buckling to cause a sudden decrease in the reaction force and generate a click feeling, and the after stroke portion AF thereafter undergoes a sudden increase in the amount of deformation. The detailed configuration of the inner dome Din will be described below.

First, with regard to the click generating portion CL, a thick portion 25 between both ends (the connecting portions 24 and 26) extends straight and has a uniform wall thickness in a cross section parallel to the center line C0. With regard to the after stroke portion AF, the wall thickness of a thick portion 23 between the connecting portions 24 and 22 increases gradually from the connecting portion 24 toward the distal end portion 21. However, the uniform wall thickness of the thick portion 25 of the click generating portion CL is less than or equal to the minimum thickness of the thick portion 23 of the after stroke portion AF.

When the angles of inclination of the thick portions 23 and 25 are defined with respect to the center line regarding the respective thickness directions of the thick portions 23 and 25, the click generating portion CL and the after stroke portion AF are both inclined with respect to the center line C0 (the direction of pressing), where the degree of inclination of the thick portion 25 of the click generating portion CL with respect to the direction of pressing is larger than the degree of inclination of the thick portion 23 of the after stroke portion AF with respect to the direction of pressing. That is, the thick portion 23 and the center line C0 form an acute angle of θa while the thick portion 25 and the center line C0 form an acute angle of θc, where θc>θa.

Figure 4:
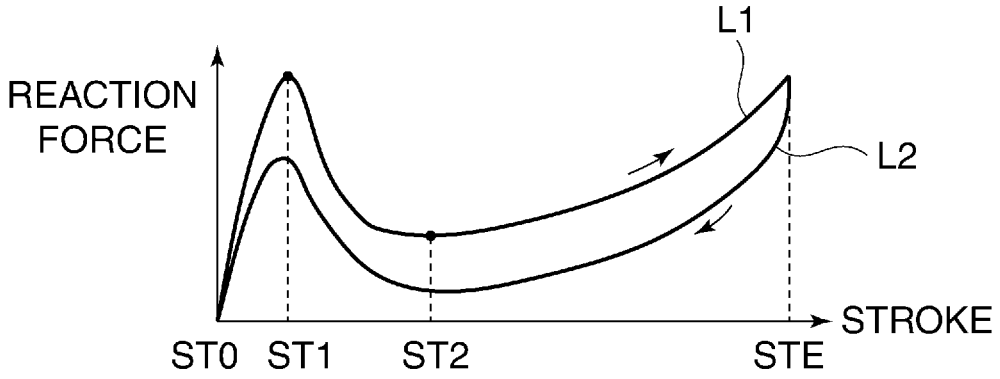
FIG. 4 is a graph illustrating a reaction force characteristic of an inner dome in FIG. 3.

FIG. 4 is a graph illustrating a reaction force characteristic of the inner dome Din in FIG. 3. A horizontal axis represents a position in the inner dome stroke, and a vertical axis represents a reaction force. An upper curve L1 represents a forward process (forward key process), and a lower curve L2 represents a return process (key release process).

When the distal end portion 21 comes into contact with the base surface 93*a* at start position ST0 of the inner dome stroke, the inner dome Din starts to generate a reaction force. The reaction force increases immediately but then decreases rapidly due to buckling of the click generating portion CL at position ST1. This generates the maximum peak of the reaction force. The reaction force by the click generating portion CL remains small after decreasing rapidly, whereas the reaction force of the after stroke portion AF starts to increase. The minimum peak of the reaction force by a resultant force of both the click generating portion CL and the after stroke portion AF occurs at position ST2, and a subsequent increase in the reaction force mainly depends on the after stroke portion AF. The reaction force increases gradually up to end position of pressing STE. The value of the minimum peak is less than or equal to half the value of the maximum peak. This increases a difference in the reaction force in the inner dome stroke to make the click feeling stand out.

Here, position ST1 and position ST2 are both positioned in the region corresponding to a first half of the inner dome stroke (ST0 to STE) (on the side closer to position ST0 than to position STE). This is to sufficiently secure a change in the reaction force of after stroke after position ST2. No or short after stroke causes the stroke to end immediately after the click, thereby making the click feeling obscure. Assuming that the key depression stroke of the key 92 equals 10 mm, start position ST0 of the inner dome stroke corresponds to a position that is 70% (about 7 mm) from a non-operated position in the key depression stroke of the key 92. Positions ST0, ST1, and ST2 are set in the aforementioned manner to allow position ST1 to correspond to a stroke position at which a click feeling is desired at the time of key depression. Moreover, the minimum peak occurs immediately after the maximum peak so that, together with the subsequent after stroke, a distinct click feeling can be obtained even in the range of only 30% of the key depression stroke.

Figure 5A:
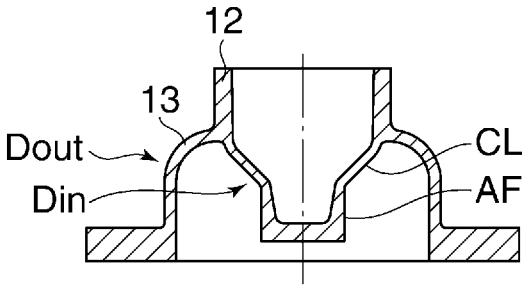
FIGS. 5A to 5F are process diagrams illustrating transitions of deformation of the key switch in FIG. 3 in its pressing process.
Figure 5D:
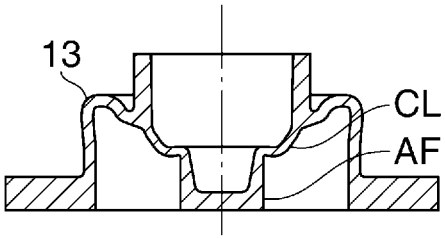
Figure 5B:
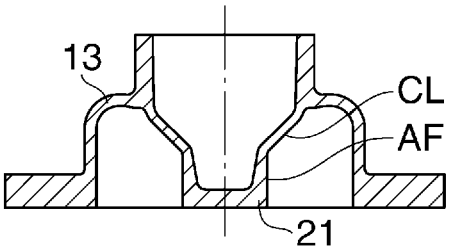
Figure 5E:
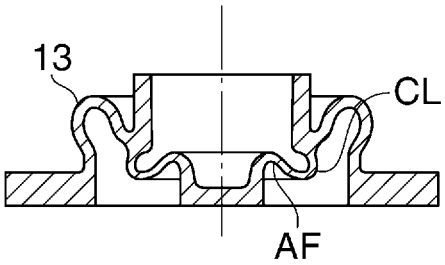
Figure 5C:
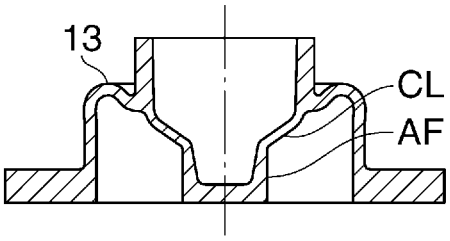

FIGS. 5A to 5F are diagrams illustrating transitions of deformation of the key switch 10 in the pressing process thereof. When the head portion 12 is pressed from a non-pressed state (FIG. 5A) at the time of no performance operation, the skirt portion 13 of the outer dome Dout starts to deform first. Once the distal end portion 21 of the inner dome Din comes into contact with the base surface 93*a* (FIG. 5B), the inner dome Din is compressed and starts to generate a reaction force, which increases as the pressing continues (FIG. 5C and positions ST0 to ST1 in FIG. 4).

Next, having received the compressive force that has reached a certain level or higher, the click generating portion CL undergoes buckling to deform. The reaction force of the inner dome Din generates the maximum peak (position ST1 in FIG. 4) and decreases rapidly (FIG. 5D). This generates a click feeling. The click generating portion CL undergoes large deformation prior to the after stroke portion AF because of the difference in the configuration therebetween as described above. First, the thick portion 25 of the click generating portion CL extends straight and is not curved unlike a conventional configuration in which deformation starts gradually from a curved portion, whereby the click generating portion CL undergoes buckling being an abrupt deformation as a mode of deformation. Moreover, the wall thickness of the thick portion 25 of the click generating portion CL is less than or equal to the minimum thickness of the thick portion 23 of the after stroke portion AF, and at the same time the degree of inclination of the thick portion 25 with respect to the direction of pressing is larger than the degree of inclination of the thick portion 23 with respect to the direction of pressing. Therefore, the thick portion 25 that is not thick, has large inclination, and has low rigidity in the direction of pressing cannot withstand the compressive force and starts to deform first.

Figure 5F:
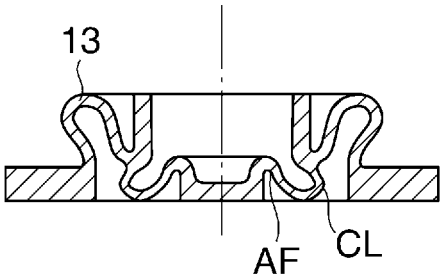

The after stroke portion AF does not yet undergo significant deformation until the click generating portion CL buckles, but undergoes a sudden increase in the amount of deformation immediately after buckling of the click generating portion CL (FIG. 5E). Specifically, with the click generating portion CL having already undergone large deformation, the after stroke portion AF starts to deform so as to be curled from the connecting portion 24. The thick portion 23 is thinner as it is closer to the connecting portion 24, so that the deformation spreads from the thinner side close to the connecting portion 24 and transitions to the thicker side. Accordingly, the reaction force generated by the after stroke portion AF is small at the beginning of deformation but increases as the deformation shifts to the thick portion. The minimum peak of the reaction force occurs at that point when the reaction force generated by the inner dome Din turns to increase (position ST2 in FIG. 4). This makes the click feeling distinct. Thereafter, the reaction force of mainly the after stroke portion AF increases gradually, and the switch is eventually pressed to the end position of the inner dome stroke (FIG. 5F).

Figure 10A:
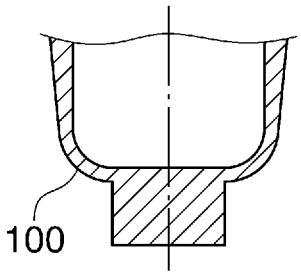
FIGS. 10A to 10C are process diagrams illustrating transitions of deformation of an inner dome of a conventional key switch in its pressing process.
Figure 10B:
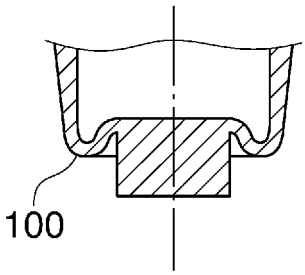
Figure 10C:
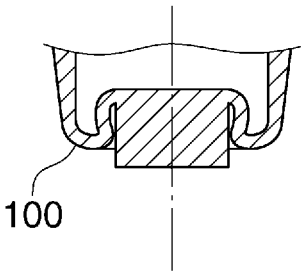
Figure 11:
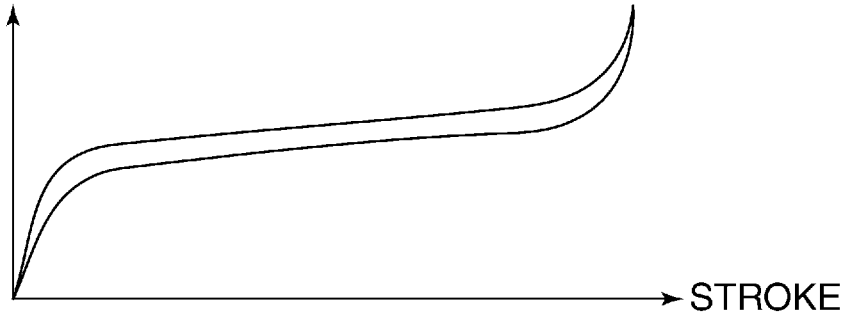
FIG. 11 is a graph illustrating a reaction force characteristic of the inner dome of the conventional key switch.

Here, the mode of deformation of the inner dome Din is contrasted with that of the conventional configuration. FIGS. 10A to 10C are process diagrams illustrating transitions of deformation of an inner dome of a conventional key switch in its pressing process. FIG. 11 is a graph illustrating a reaction force characteristic of the inner dome of the conventional key switch.

An inner dome 100 of the conventional configuration has a distinct curved portion, from which deformation starts gradually and spreads to the entire dome (FIGS. 10A to 10C). The deformation thus does not result in an abrupt mode like buckling, whereby the reaction force increases slowly (FIG. 11). Accordingly, no reaction force corresponding to a click feeling is generated in the conventional configuration.

In the present embodiment, the click generating portion CL and the after stroke portion AF do not have a large curved shape (round shape) and are thus prone to the mode of buckling at the start of deformation, where the click generating portion CL is designed to undergo buckling first by adjusting the thickness and the angle of inclination thereof. Moreover, the click generating portion CL is inclined with respect to the direction of pressing so that the buckling position in the stroke is easily designed at a desired position.

According to the present embodiment, the click generating portion CL causes the sudden increase in the amount of deformation prior to the after stroke portion AF in the pressing process, so that the click feeling is reliably generated in the first half of the pressing stroke and that an after stroke section can be reliably secured thereafter. As a result, the click feeling can be generated at an appropriate position in the pressing stroke. The amount of deformation of the after stroke portion AF increases rapidly after buckling of the click generating portion CL to be able to generate the distinct click feeling by buckling, during which the after stroke portion can be adapted to not undergo deformation. The click feeling can be generated reliably as a result.

Moreover, the wall thickness of the thick portion 25 of the click generating portion CL is less than or equal to the minimum thickness of the thick portion 23 of the after stroke portion AF, so that the click generating portion CL can reliably undergo buckling prior to the abrupt deformation of the after stroke portion AF. The thickness of the thick portion 23 of the after stroke portion AF changes gradually in the cross section parallel to the direction of pressing so that, in the pressing process, the reaction force generated by the after stroke portion AF after generation of the click feeling can be increased gradually to be able to generate the minimum peak of the reaction force. The click feeling can thus be made distinct.

The maximum peak of the reaction force generated by the inner dome Din in the pressing process is positioned in the first half of the inner dome stroke (ST0 to STE). The minimum peak of the reaction force generated by the inner dome Din is also positioned in the first half of the inner dome stroke immediately after the maximum peak. Moreover, the reaction force peak is reached in the first half of a period from contact between the distal end portion of the inner dome and the base surface to the end of performance, so that a stroke from the reaction force peak to the end of performance can be enlarged such as to be able to make the click feeling more distinct. As a result, the click feeling can be generated at an appropriate position in the pressing stroke of the performance operation. Specifically, in order to obtain such an effect, it is of great significance to generate the reaction force not in the outer dome Dout but in the inner dome Din. That is, the outer dome Dout starts to deform before the switch is turned on, and has already generated a reaction force by the time the switch is turned on, whereby it is difficult to generate the reaction force peak after the switch is turned on. On the other hand, the inner dome Din can easily generate the reaction force peak after the switch is turned on.

In the present embodiment, the reaction force generator is configured as the key switch 10 to be applied to the electronic musical instrument, and the movable contact 27 and the fixed contact 97 form the pair of electrical contacts to detect the key depressing operation, whereby the reaction force generator can have a click feeling generation function and an operation detection function with respect to the performance operation.

Next, a second embodiment of the present invention will be described. While the first embodiment has one switch corresponding to the key 92, the second embodiment of the present invention has a plurality of switches corresponding to a key 92.

Figure 6:
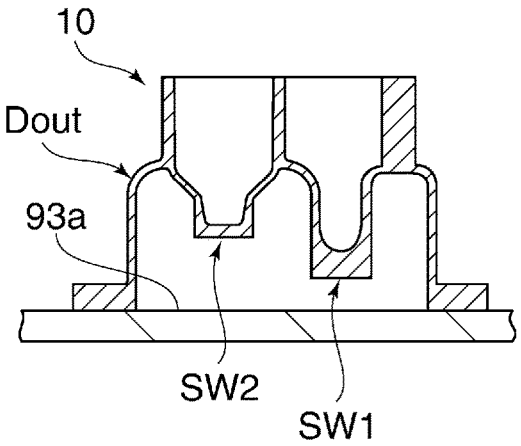
FIG. 6 is a longitudinal sectional view of a key switch serving as a reaction force generator according to a second embodiment of the present invention.
Figure 7:
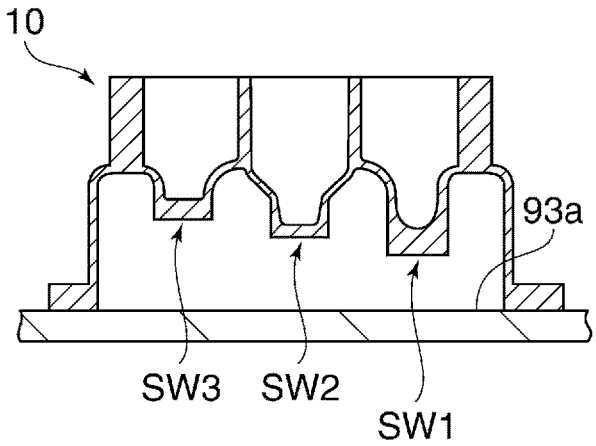
FIG. 7 is a longitudinal sectional view of a variation of the key switch serving as the reaction force generator according to the second embodiment of the present invention.

FIGS. 6 and 7 are longitudinal sectional views of a key switch 10 having two switches and a key switch 10 having three switches, respectively. Although not illustrated in detail, a movable contact of each switch SW and a corresponding fixed contact provided on a base surface 93*a* form a pair of electrical contacts. The switches SW are arranged in the same direction as a longitudinal direction of the key 92, for example.

FIG. 6 illustrates a two-make key switch having two switches SW1 and SW2. The switches SW1 and SW2 have projecting heights (corresponding to distances between distal ends of these switches and the base surface 93*a*) that are different from each other, and make contact in the order of the switch SW1 and the switch SW2 in a forward key depression process. The characteristic of particularly the inner dome Din of the key switch 10 described in the first embodiment is applied to the switch SW2 making contact second.

FIG. 7 illustrates a three-make key switch having three switches SW1, SW2, and SW3. The switches SW have projecting heights different from one another, and make contact in the order of the switch SW1, the switch SW2, and the switch SW3 in the forward key depression process. The characteristic of particularly the inner dome Din of the key switch 10 described in the first embodiment is applied to the switch SW2 making contact second from the last.

In both of the examples illustrated in FIGS. 6 and 7, an inner dome Din is configured such that the maximum peak of a reaction force generated by the inner dome Din of the switch SW2 occurs at a stroke position at which a click feeling is generated in a key depression stroke of an acoustic piano. As a result, a click feeling can be generated at an appropriate position in a pressing stroke of a performance operation.

Next, a third embodiment of the present invention will be described. The inner dome Din of the first embodiment is configured such that the after stroke portion AF is connected to the distal end portion 21 while the click generating portion CL is connected to the outer dome Dout. In the third embodiment of the present invention, the positional relationship between a click generating portion CL and an after stroke portion AF is opposite to the positional relationship therebetween in the first embodiment.

Figure 8:
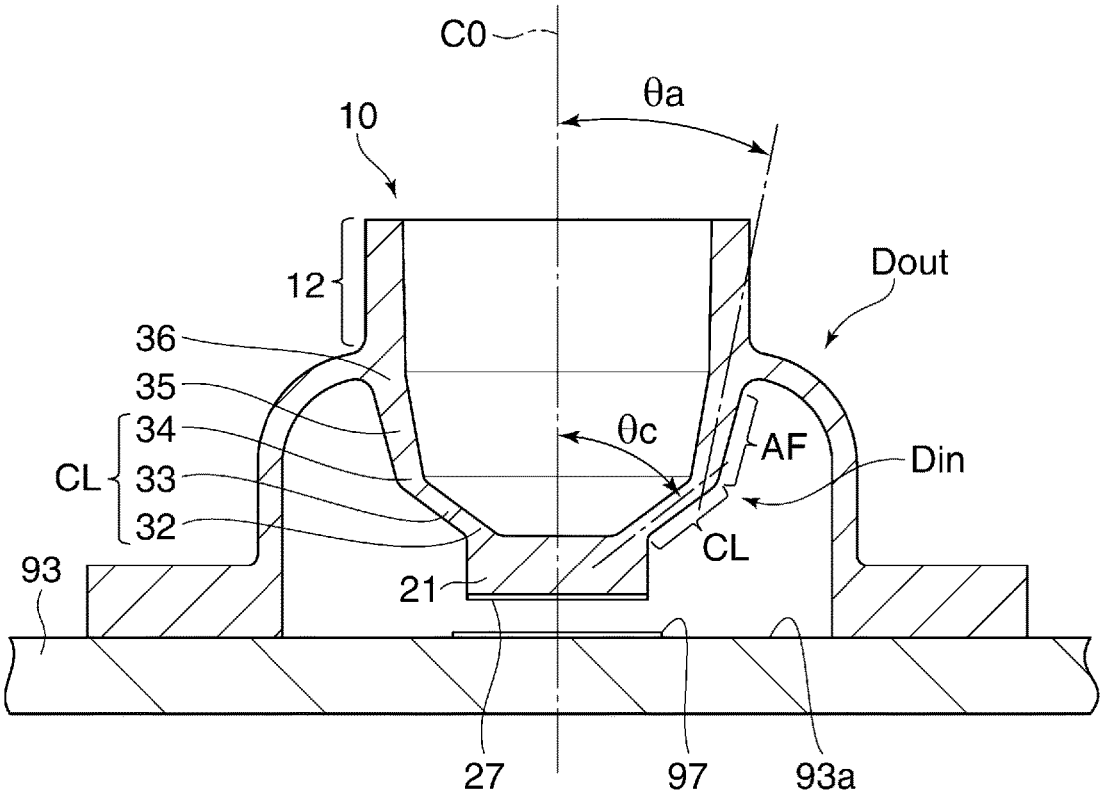
FIG. 8 is a longitudinal sectional view of a key switch serving as a reaction force generator according to a third embodiment of the present invention.

FIG. 8 is a longitudinal sectional view of a key switch 10 serving as a reaction force generator according to the third embodiment of the present invention. The configuration of an outer dome Dout is similar to that of the first embodiment. In an inner dome Din, the click generating portion CL is connected to the after stroke portion AF at a connecting portion 34. The connecting portion 34 is one end of the click generating portion CL and is also one end of the after stroke portion AF. The click generating portion CL is also connected to a distal end portion 21 at a connecting portion 32. The after stroke portion AF is connected to the outer dome Dout at a connecting portion 36. The connecting portion 36 is also a part of an area of connection between a head portion 12 and a skirt portion 13 of the outer dome Dout.

With regard to the click generating portion CL, a thick portion 33 between both ends (the connecting portions 34 and 32) extends straight and has a uniform wall thickness in a cross section parallel to a center line C0. With regard to the after stroke portion AF, the wall thickness of a thick portion 35 between the connecting portions 34 and 36 increases gradually from the connecting portion 34 toward the connecting portion 36. However, the uniform wall thickness of the thick portion 33 of the click generating portion CL is less than or equal to the minimum wall thickness of the thick portion 35 of the after stroke portion AF.

The click generating portion CL and the after stroke portion AF are both inclined with respect to the center line C0 (the direction of pressing). The degree of inclination of the thick portion 33 of the click generating portion CL with respect to the direction of pressing is larger than the degree of inclination of the thick portion 35 of the after stroke portion AF with respect to the direction of pressing. That is, the thick portion 33 and the center line C0 form an acute angle of $\theta a$ while the thick portion 35 and the center line C0 form an acute angle of $\theta c$, where $\theta c > \theta a$.

Figure 9A:
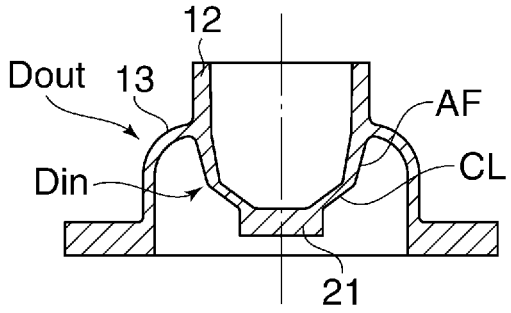
FIGS. 9A to 9F are process diagrams illustrating transitions of deformation of the key switch in FIG. 8 in its pressing process.
Figure 9D:
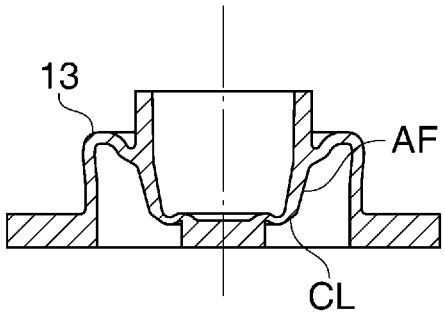
Figure 9B:
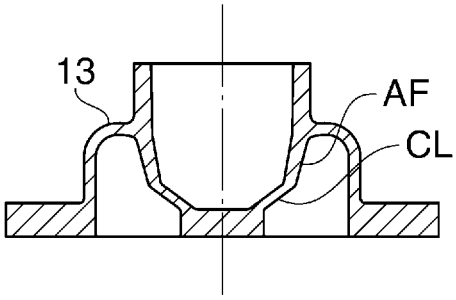
Figure 9E:
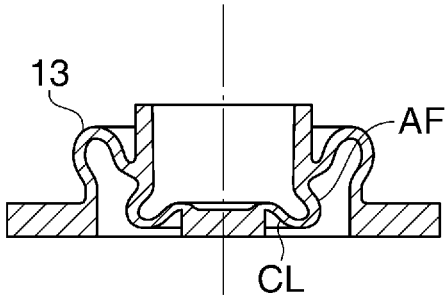
Figure 9C:
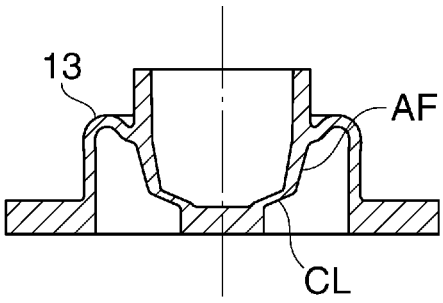
Figure 9F:
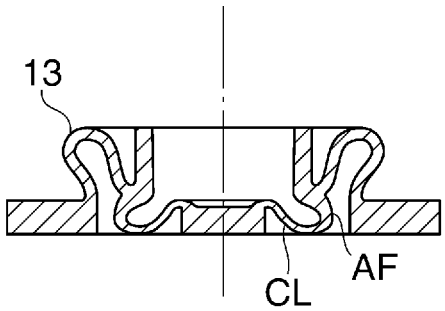

FIGS. 9A to 9F are process diagrams illustrating transitions of deformation of the key switch 10 in FIG. 8 in its pressing process. The transition of deformation in the present embodiment is basically similar to that in the first embodiment. The main operation is that the click generating portion CL undergoes large deformation prior to the after stroke portion AF when the distal end portion 21 of the inner dome Din comes into contact with a base surface 93*a* to cause a load applied to the inner dome Din to reach a certain level or higher (FIGS. 9A to 9D). That is, the click generating portion undergoes buckling to deform while causing the maximum peak of a reaction force. The after stroke portion AF undergoes a sudden increase in the amount of deformation immediately after buckling of the click generating portion CL (FIG. 9E). At that time, the thickness of the thick portion 35 of the after stroke portion AF is thinner as it is closer to the connecting portion 34, so that the deformation of the thick portion 35 spreads so as to be curled from the thin side close to the connecting portion 34. The reaction force generated by the inner dome Din reaches the minimum peak, and thereafter the reaction force of mainly the after stroke portion AF increases gradually to eventually cause the switch to be pressed to an end position of an inner dome stroke (FIG. 9F).

The present embodiment can thus obtain an effect similar to that of the first embodiment in terms of generating a distinct click feeling at an appropriate position in the pressing stroke.

Note that the configuration of the present embodiment may be applied to the second embodiment (FIGS. 6 and 7) by applying the configuration of the inner dome Din in FIG. 8 to the switch SW2.

In the aforementioned embodiments, the thickness of the thick portions 23 and 35 of the after stroke portion AF changes to be thinner toward the click generating portion CL. The thickness may however change in a direction opposite to what is illustrated above in terms of gradually increasing the reaction force of the after stroke portion AF after the click generating portion CL first undergoes large deformation.

Note that the place where the key switch 10 is disposed is not limited to the surface of the substrate. In obtaining only the reaction force generation function in the key switch 10, the reaction force generator is not required to be configured as the key switch 10 having the operation detection function. When the operation detection function is omitted, the base surface need only be a surface resisting the pressing force. Accordingly, the base surface may be configured as a part of the configuration of the reaction force generator, or a surface of the place where the reaction force generator is mounted may be used as the base surface.

Note that in each of the aforementioned embodiments, the driver 96 may be configured to press the head portion 12 of the outer dome Dout by an operation of the operator, and can thus be applied to a musical instrument other than the keyboard instrument such as a pad switch of a rhythm machine. Moreover, the operator is not limited to the performance operator but may be a setting operator. Furthermore, the present invention can be applied to a device other than the electronic musical instrument.

Figure 12:
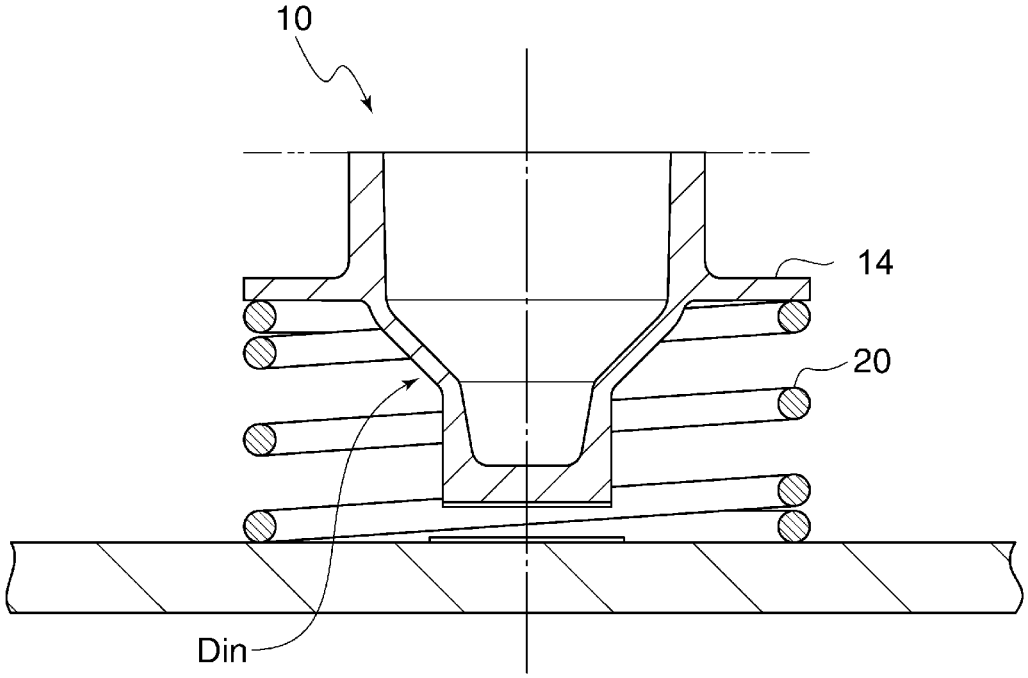
FIG. 12 is a longitudinal sectional view of a key switch serving as a reaction force generator according to a fourth embodiment of the present invention.

In each of the aforementioned embodiments, the key switch 10 includes the outer dome Dout made of bulging rubber as the elastic structure capable of elastic deformation; however, another elastic structure may be included instead of the outer dome Dout. For example, as illustrated in FIG. 12, the key switch 10 may include a coil spring 20 that encloses the inner dome Din, and a flange 14 that is provided at a lower part of the head portion 12 and extends substantially horizontally such as to come into contact with a top of the coil spring 20 and receive a reaction force. In this case, the natural length and a spring constant of the coil spring 20 are set such that the coil spring 20 is compressed prior to the inner dome Din when the head portion 12 is pressed.

Although the present invention has been described in detail on the basis of the embodiments, the present invention is not limited to these specific embodiments but includes various embodiments without departing from the scope of the present invention. Moreover, the aforementioned embodiments may be partly combined as appropriate.

This application claims priority based on Japanese Patent Application No. 2015-164766 filed on Aug. 24, 2015, the entire contents of which are incorporated herein by reference.

REFERENCE SIGNS LIST

10 key switch (reaction force generator)
21 distal end portion
Din inner dome
Dout outer dome
CL click generating portion
AF after stroke portion
24, 26, 32, 34 connecting portion
23, 25, 33, 35 thick portion
93*a* base surface

What is claimed is:

1. A reaction force generator that is disposed on a base surface comprising:

an elastic structure; and a dome that is made of an elastic member, and includes a portion bulging toward the base surface and includes at least an after stroke portion and a click generating portion, wherein:

a reaction force is generated by elastic deformation of the elastic structure and the dome in a pressing process in which the elastic structure is pressed, and the after stroke portion and the click generating portion are both inclined with respect to the direction of pressing in the dome, the click generating portion has one end connected to the after stroke portion, and a degree of inclination of a thick portion between both ends of the click generating portion with respect to the direction of pressing is larger than a degree of inclination of the after stroke portion with respect to the direction of pressing, the dome starts to deform once a distal end portion of the dome comes into contact with the base surface after the elastic structure starts to deform in the pressing process, the click generating portion undergoes buckling in the pressing process to cause a sudden decrease in a reaction force and generate a click feeling, the click generating portion causing a sudden increase in an amount of deformation prior to the after stroke portion, and the amount of deformation of the after stroke portion increases rapidly after the click generating portion undergoes buckling.

2. The reaction force generator according to claim 1, wherein the thick portion between the both ends of the click generating portion extends straight and has a uniform wall thickness in a cross section parallel to the direction of pressing.

3. The reaction force generator according to claim 2, wherein the uniform wall thickness of the click generating portion is less than or equal to a minimum thickness of a thick portion of the after stroke portion.

4. The reaction force generator according to claim 1, wherein the thickness of the thick portion of the after stroke portion changes gradually in a cross section parallel to the direction of pressing.

5. The reaction force generator according to claim 1, wherein the elastic structure is made of the elastic member, has a dome shape having a portion bulging away from the base surface, and encloses the dome.

6. A keyboard device of an electronic musical instrument comprising:

a reaction force generator that is disposed on a base surface, and includes:

an elastic structure; and a dome that is made of an elastic member, and includes a portion bulging toward the base surface and includes at least an after stroke portion and a click generating portion, wherein:

the reaction force generator generates a reaction force by elastic deformation of the elastic structure and the dome in a pressing process in which the elastic structure is pressed by a performance operation, the after stroke portion and the click generating portion are both inclined with respect to the direction of pressing in the dome, the click generating portion has one end connected to the after stroke portion, and a degree of inclination of a thick portion between both ends of the click generating portion with respect to the direction of pressing is larger than a degree of inclination of the after stroke portion with respect to the direction of pressing, the dome starts to deform once a distal end portion of the dome comes into contact with the base surface after the elastic structure starts to deform in the pressing process, the click generating portion undergoes buckling in the pressing process to cause a sudden decrease in a reaction force and generate a click feeling, and a maximum peak of the reaction force generated by the dome in the pressing process is positioned in a first half of a dome stroke spanning from the contact between the distal end portion of the dome and the base surface to an end of the performance operation.

7. The keyboard device of an electronic musical instrument according to claim 6, wherein an amount of deformation of the after stroke portion increases rapidly after the click generating portion undergoes buckling in the pressing process.

8. The keyboard device of an electronic musical instrument according to claim 6, wherein a minimum peak of the reaction force generated by the dome after the click generating portion undergoes buckling in the pressing process is positioned in the first half of the dome stroke.

9. The keyboard device of an electronic musical instrument according to claim 6, wherein each of a pair of electrical contacts detecting the performance operation by conduction is formed at the distal end portion of the dome or on the base surface facing the distal end portion.

10. A keyboard device of an electronic musical instrument comprising:

a reaction force generator that is disposed on a base surface, and includes:

an elastic structure; and a plurality of domes that are made of an elastic member and each includes a portion bulging toward the base surface, wherein:

the reaction force generator generates a reaction force by elastic deformation of the elastic structure and the domes in a pressing process in which the elastic structure is pressed by a performance operation, one of the plural domes includes at least an after stroke portion and a click generating portion, and the after stroke portion and the click generating portion are both inclined with respect to the direction of pressing in the dome including the click generating portion, the click generating portion has one end connected to the after stroke portion, and a degree of inclination of a thick portion between both ends of the click generating portion with respect to the direction of pressing is larger than a degree of inclination of the after stroke portion with respect to the direction of pressing, plural electrical contacts detecting the performance operation by conduction are respectively formed at the distal end portion of each of the domes and on the base surface facing the distal end portions, a distance between the distal end portion of each of the plurality of domes and the base surface is different for each dome at the time of no performance operation, the domes start to deform in order of contact between the distal end portion and the base surface after the elastic structure starts to deform in the pressing process, and the dome including the click generating portion is a dome with the distal end portion coming into contact with the base surface second from the last in the pressing process, and the click generating portion undergoes buckling in the pressing process to cause a sudden decrease in a reaction force and generate a click feeling.

11. The keyboard device of an electronic musical instrument according to claim 10, wherein an amount of deformation of the after stroke portion increases rapidly after the click generating portion undergoes buckling in the pressing process.

12. A keyboard device of an electronic musical instrument comprising:

a reaction force generator that is disposed on a base surface, and includes:

an elastic structure; and two domes that are made of an elastic member and each includes a portion bulging toward the base surface, wherein:

the reaction force generator generates a reaction force by elastic deformation of the elastic structure and the domes in a pressing process in which the elastic structure is pressed by a performance operation, one of the two domes includes at least an after stroke portion and a click generating portion, and the after stroke portion and the click generating portion are both inclined with respect to the direction of pressing in the dome including the click generating portion, the click generating portion has one end connected to the after stroke portion, and a degree of inclination of a thick portion between both ends of the click generating portion with respect to the direction of pressing is larger than a degree of inclination of the after stroke portion with respect to the direction of pressing, plural electrical contacts detecting the performance operation by conduction are respectively formed at the distal end portion of each of the domes and on the base surface facing the distal end portions, distances between the distal end portions of the two domes and the base surface are different from each other at the time of no performance operation, the domes start to deform in order of contact between the distal end portion and the base surface after the elastic structure starts to deform in the pressing process, and the dome including the click generating portion is a dome with the distal end portion coming into contact with the base surface second in the pressing process, and the click generating portion undergoes buckling in the pressing process to cause a sudden decrease in a reaction force and generate a click feeling.

* * * * *